US006827547B2

(12) United States Patent
Robb

(10) Patent No.: US 6,827,547 B2
(45) Date of Patent: Dec. 7, 2004

(54) ENGINE COOLING FAN HAVING IMPROVED AIRFLOW CHARACTERISTICS

(75) Inventor: Neil E. Robb, Jackson, MI (US)

(73) Assignee: BorgWarner Inc., Auburn Hills, MI (US)

( * ) Notice: Subject to any disclaimer, the term of this patent is extended or adjusted under 35 U.S.C. 154(b) by 53 days.

(21) Appl. No.: 10/353,476

(22) Filed: Jan. 29, 2003

(65) Prior Publication Data

US 2004/0146400 A1 Jul. 29, 2004

(51) Int. Cl.[7] ..... F04D 29/54

(52) U.S. Cl. ..... 415/1; 415/211.2; 415/213.1; 415/221; 416/189

(58) Field of Search ..... 415/1, 211.2, 213.1, 415/221, 228; 416/189

(56) References Cited

U.S. PATENT DOCUMENTS

| | | | | |
|---|---|---|---|---|
| 2,668,523 A | | 2/1954 | Lamb | |
| 3,144,859 A | | 8/1964 | Walton | |
| 3,433,403 A | | 3/1969 | Gerlitz | |
| 3,937,189 A | | 2/1976 | Beck | |
| 4,061,188 A | | 12/1977 | Beck | |
| 4,329,946 A | | 5/1982 | Longhouse | |
| 4,406,581 A | | 9/1983 | Robb et al. | |
| 5,224,447 A | | 7/1993 | Braatz et al. | |
| 5,577,888 A | * | 11/1996 | Capdevila et al. | 415/210.1 |
| 5,590,624 A | | 1/1997 | Emond et al. | |
| 6,024,536 A | * | 2/2000 | Tsubakida et al. | 416/189 |
| 6,139,265 A | | 10/2000 | Alizadeh | |
| 6,142,733 A | | 11/2000 | Alizadeh et al. | |
| 6,206,635 B1 | | 3/2001 | Golm et al. | |
| 6,309,178 B1 | | 10/2001 | Kim et al. | |
| 6,398,492 B1 | * | 6/2002 | Cho et al. | 415/191 |
| 6,450,760 B1 | | 9/2002 | Furukawa et al. | |
| 6,595,744 B2 | * | 7/2003 | Van Houten | 415/173.1 |

FOREIGN PATENT DOCUMENTS

| | | |
|---|---|---|
| DE | 25 05 563 | 9/1975 |

* cited by examiner

*Primary Examiner*—Ninh H. Nguyen
(74) *Attorney, Agent, or Firm*—Artz & Artz, P.C.; Greg Dziegielewski

(57) ABSTRACT

A stator and diffuser assembly is introduced between an engine cooling fan and engine. The stator acts increase the static efficiency per unit airflow of the axial fan by reducing the rotational component of air traveling through the fan and by directing the airflow in an axial direction towards the engine. The diffuser acts to increase the static efficiency per unit airflow of the axial fan used by decelerating the airflow, thereby providing more airflow to the engine at a given fan rotational speed. The stator and diffuser assembly thus decreases the amount of horsepower necessary to drive the fan at a given rotational speed and reduces noise.

23 Claims, 6 Drawing Sheets

ENGINE COOLING FAN HAVING IMPROVED AIRFLOW CHARACTERISTICS

TECHNICAL FIELD

The present invention relates to engine cooling systems, and more particularly, to an engine-cooling fan having improved airflow characteristics.

BACKGROUND ART

The use of fans to move air through heat exchangers is well known, for example in the field of air conditioning and the field of motor vehicle cooling. A fan for such an application may consist of a hub member and plural blade members, each blade member having a root portion and a tip portion, the root portions of each blade being secured to the hub portion such that the blades extend substantially radially of the hub portion. A blade tip support ring may link the blades near to, or more usually, at their tip portions.

Such a fan, which is often driven by an electric motor, or via a transmission from an associated engine, is usually disposed so that the fan radial plane extends parallel to a face portion of the associated heat exchanger.

Fans of this type are commonly referred to as "axial flow fans." However, although the blades are pitched so as to move air in an axial direction, nevertheless the action of the fan causes a relatively complicated airflow. It will, for example, be apparent that rotation of the fan causes air that has passed through the fan to have a rotational component of motion, due to the movement of the blades, as well as a linear component induced by the pitch of the blades. Leakage of air around the fan blade tips (so-called tip vortices) between the high and low-pressure sides of the fan may also occur.

Furthermore, the particular blade form and the particular blade disposition selected for a fan, for example the dihedral angle of the blade, the variation in pitch along the blade span or the chord length of the blade (taken along a radial cross section) will affect the pressure distribution provided immediately adjacent the fan, and hence will affect the flow of air which has passed through the fan.

A fan of the type used to move air through a heat exchanger is intended to provide airflow in an axial direction; components in other directions are wasteful of energy. Such wasteful components of airflow impinge upon the various mechanical structures around the heat exchanger and upon the heat exchanger itself to increase the overall noise produced by the system.

It is accordingly an object of the present invention to at least partially mitigate the above-mentioned difficulties.

SUMMARY OF THE INVENTION

The above and other objects of the invention are met by the present invention, in which either a stator or a diffuser assembly is closely coupled with an engine mounted cooling fan.

Both the stator and diffuser assembly independently improve airflow efficiency, thereby reducing vibrational noise associated with inefficient airflow. The improved airflow also acts to increase the cooling capabilities of the fan, which can lead to improved engine fuel economy.

In addition, by mounting the stator or diffuser assembly to the engine, a tighter tip clearance to the blades of the fan can be achieved, which reduces airflow inefficiency and further leads to reduced noise levels and fuel efficiency.

Other features, benefits and advantages of the present invention will become apparent from the following description of the invention, when viewed in accordance with the attached drawings and appended claims.

BEST MODE(S) FOR CARRYING OUT THE INVENTION

Figure 1:
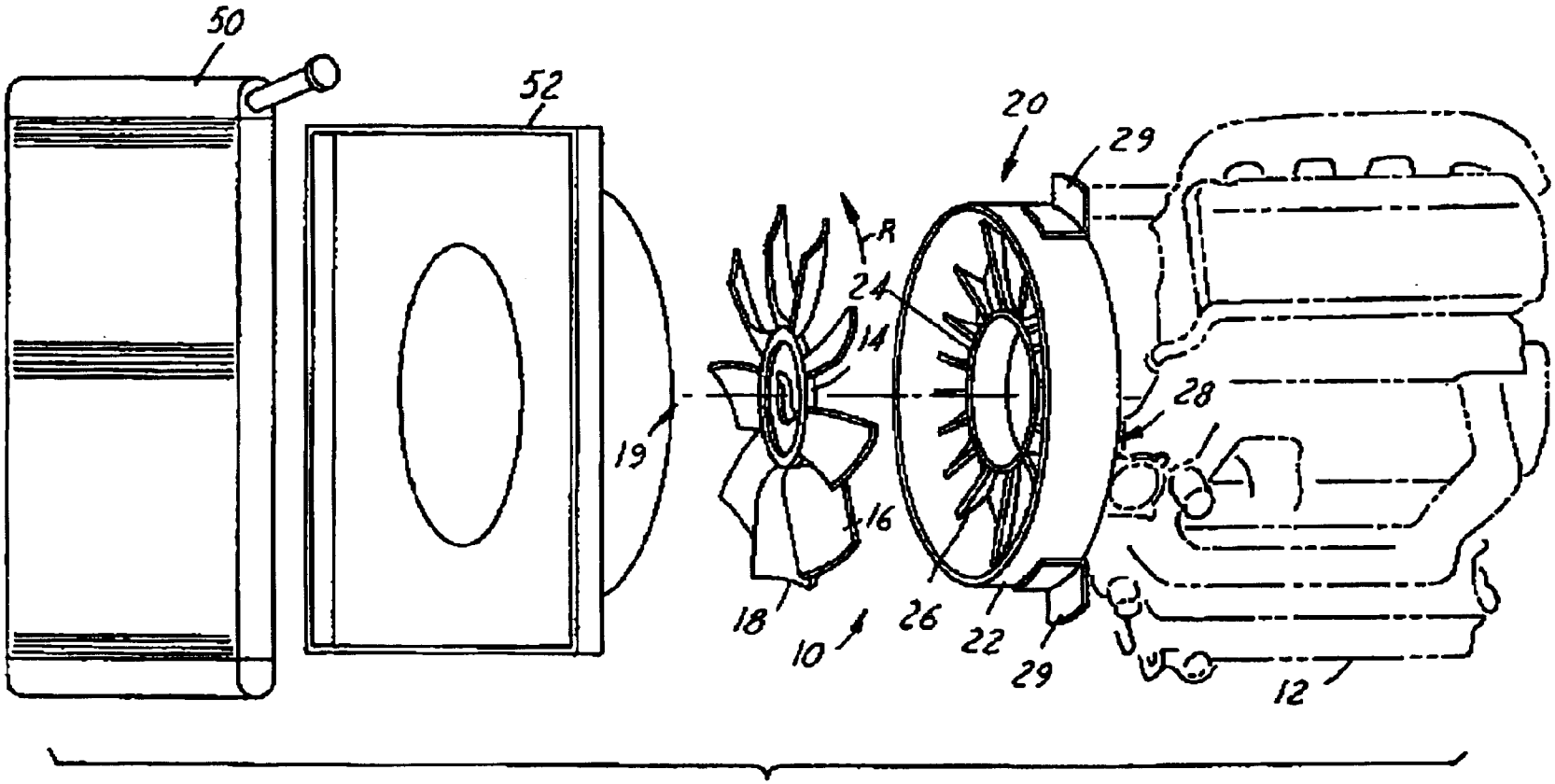
FIG. 1 is a perspective view of an engine having a cooling system according to a preferred embodiment of the present invention.
Figure 2:
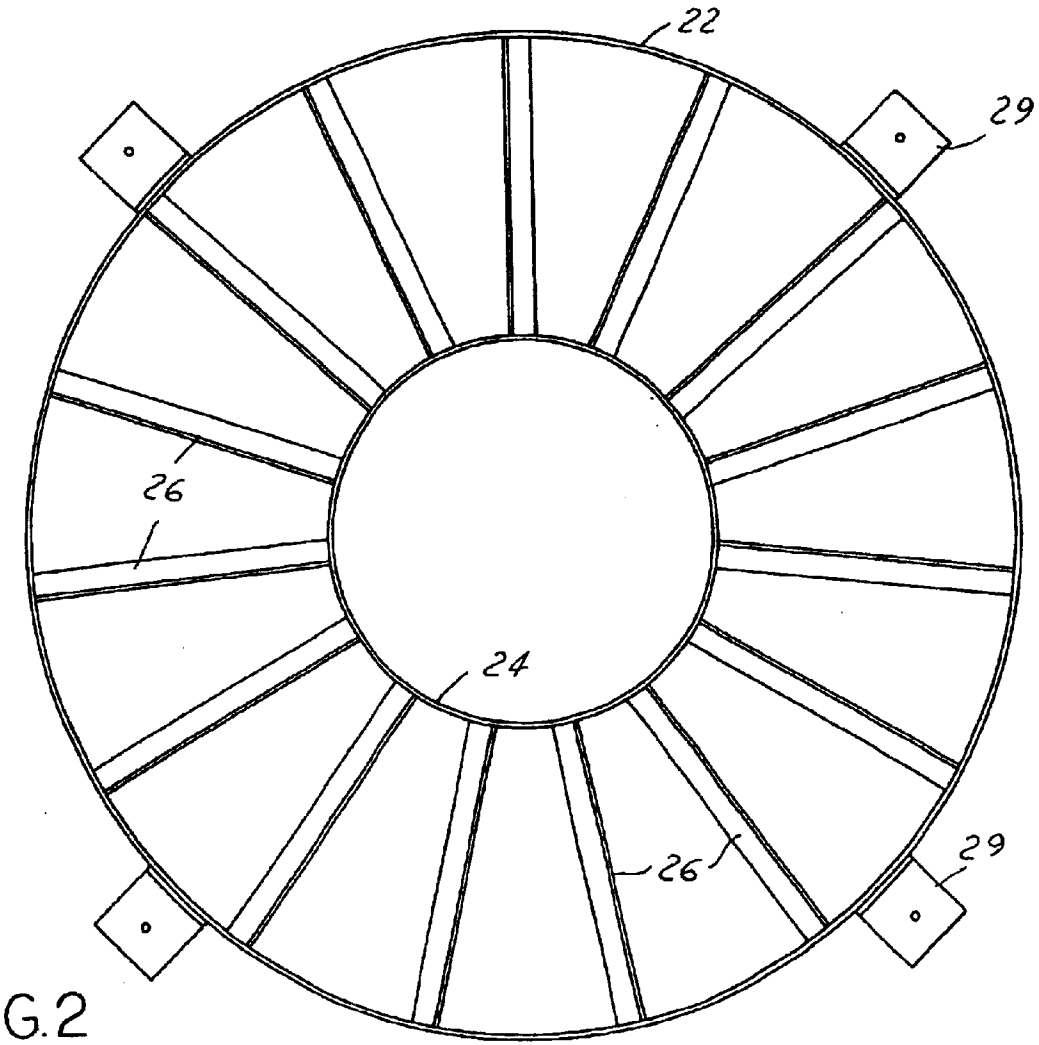
FIG. 2 is a front view of a portion of FIG. 1.
Figure 3:
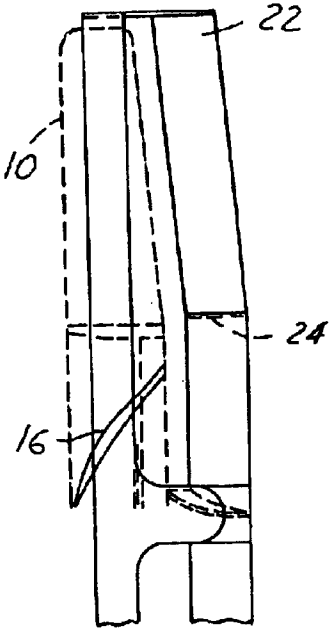
FIG. 3 is a side view of FIG. 2.

Referring now to FIGS. 1–3, an axial flow fan 10 is shown mounted to an engine 12 via a hub 14 between a stator assembly 20 and a radiator 50. The fan 10 has a plurality of fan blades 16 extending radially from said hub 14 to a tip portion 18. The shape of the blades 16 are such that as the fan 10 is rotated in direction R about a central axis 19, air is caused to move axially along the direction of rotation of the fan 10. The addition of a stator assembly 20 between the fan 10 and the engine 12 increases the static pressure per unit airflow as compared with cooling systems having a either the conventional fan shroud or tighter tip clearance fan shroud As best shown in FIGS. 2 and 3, the stator assembly 20 consists of a stator support outer ring 22 that forms a fan shroud with the associated fan 10. The stator assembly 20 also has a plurality of stator blades 26 coupled to the backside 28 of the outer ring 22 and an inner ring 24. In order to reduce tip clearance, and therefore improve fan efficiency, the stator assembly 20 is preferably mounted to the engine 12 via mounting clips 29 such that the outer support ring 22 is closely coupled to the tip portion 18 of each of the fan blades 16.

As will be described in detail below, the stator blades 26 function to "break up" the rotational components of air movement and direct the air towards a more axial flow path (i.e. the air flowing substantially parallel to the central axis 19 and towards the engine 12). Further, such airflow increases at a given static pressure are done without adversely affecting torque requirements of the fan 10.

To aid in breaking up the rotational component of air movement, as best shown in FIGS. 1 and 3, each of the stator blades 26 is slightly curved concavely with respect to the central axis 19 and inner ring 24 and in the direction towards the rotation of fan blades 16. This allows a portion of the air movement through the stator 20 to be directed in an axial direction towards the engine 12.

To further improve fan 10 performance, the outer ring 22 is also closely coupled with a radiator shroud 52 that is coupled to the radiator 50. The outer ring 22 may also be secured to the radiator shroud 52 using conventional mounting devices such as screws, bolts, adhesive or the like.

The stator assembly 20 is preferably made of a lightweight, high strength material such as molded plastic or fiber reinforced plastic. However, persons of ordinary skill appreciate that the stator assembly could also be made from other materials that are lightweight and exhibit high strength while being easy to manufacture, including metal.

In another preferred embodiment, as shown in FIGS. 4–7, a diffuser assembly, or diffuser 28, replaces the stator assembly 20 of FIGS. 1–3 above.

Figure 4:
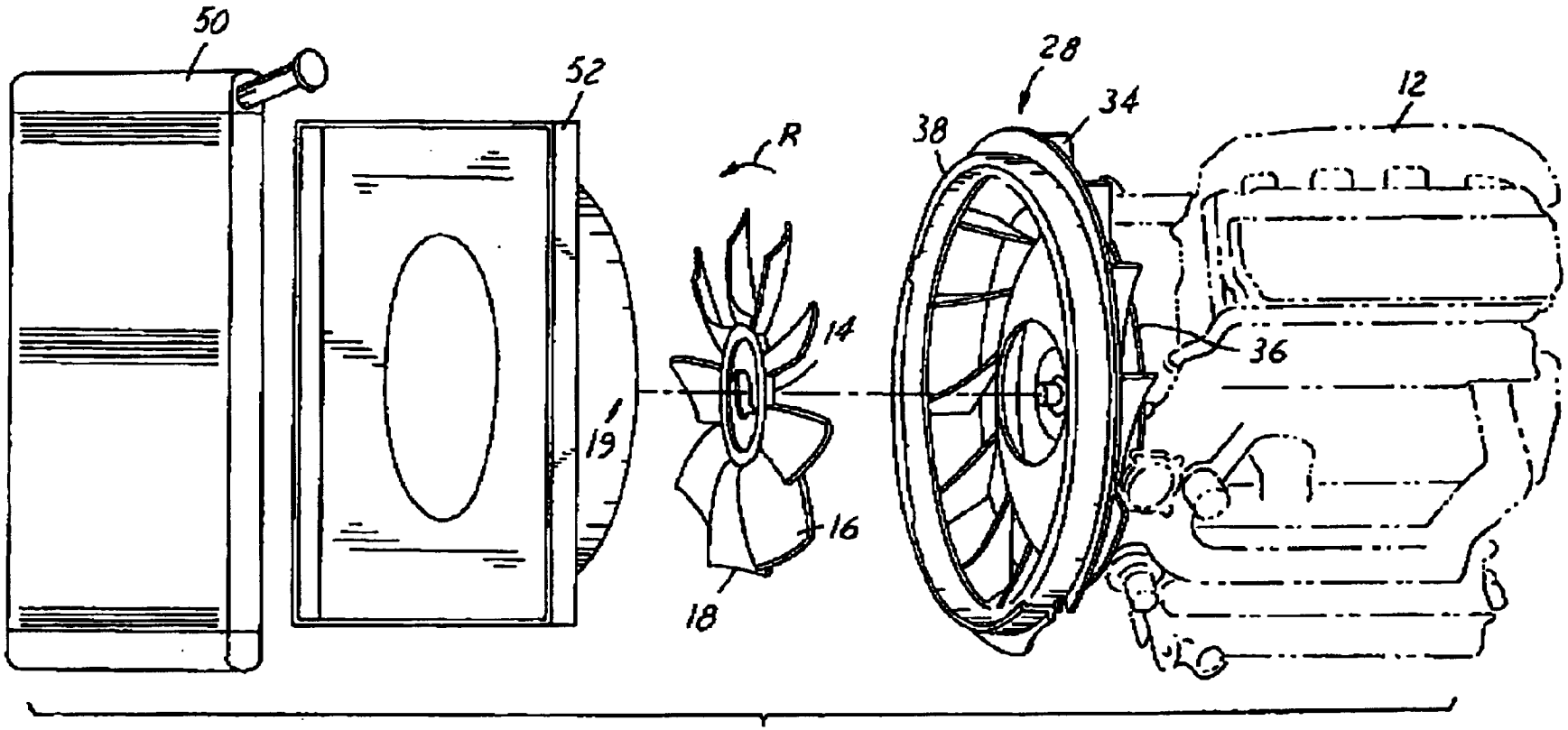
FIG. 4 is a perspective view of an engine having a cooling system according to a preferred embodiment of the present invention.
Figure 6:
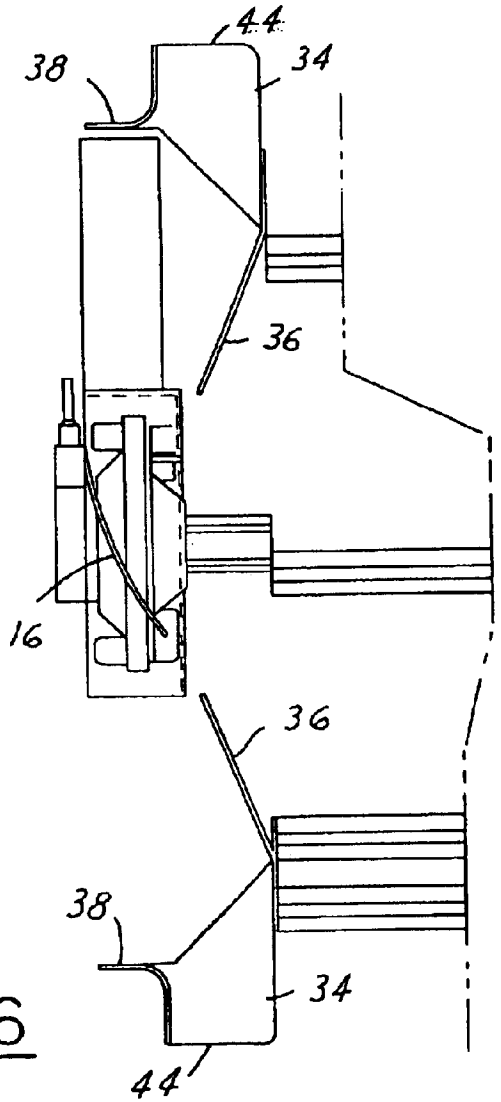
FIG. 6 is a side view of FIG. 5.
Figure 5:
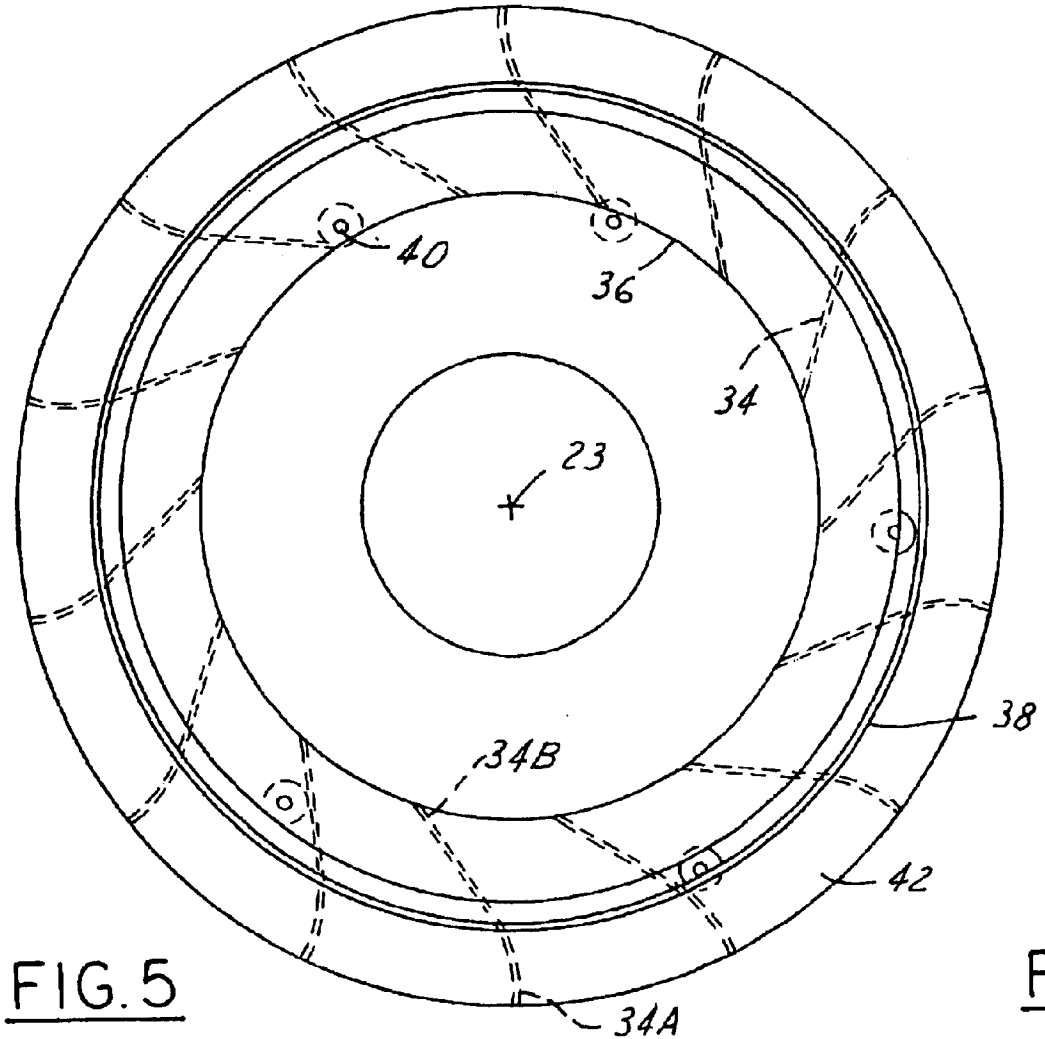
FIG. 5 is a front view of a portion of FIG. 4.
Figure 7:
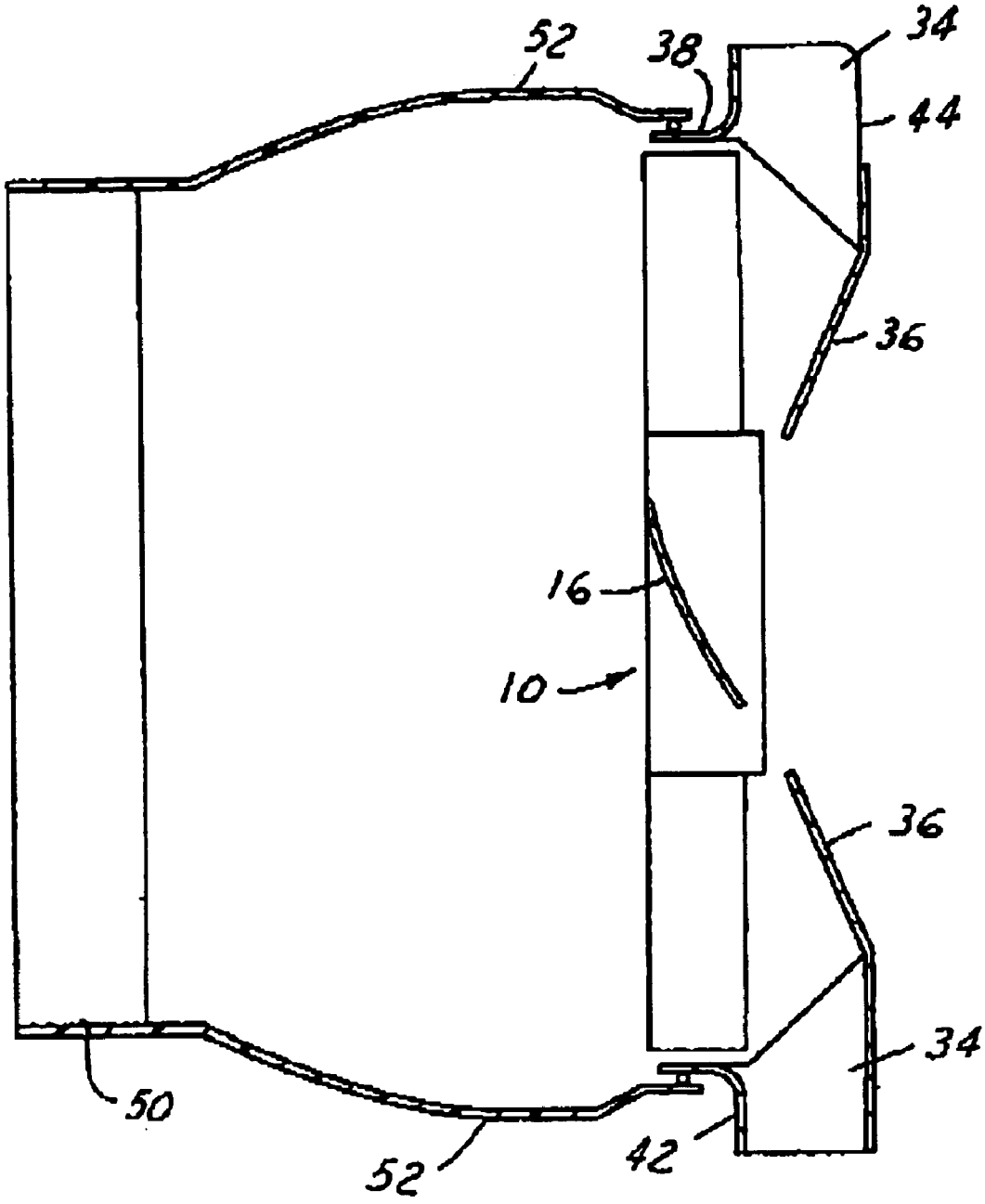
FIG. 7 is a side view of a portion of FIG. 4.

Referring now to FIGS. 4–6, the diffuser 28 has a plurality of exit guide vanes 34 coupled between a back plate 36 and an outer support ring 42. A pair of adjacent exit guide vanes 34, the outer support ring 42, and the back plate 36 together define one of a plurality of tunnels 32 used to decelerate the flow of air between the fan 14 and the engine 12. As best shown in FIG. 7, the diffuser also has a front shroud 38 coupled off of the outer support ring 42 that is preferably coupled to the radiator shroud 52.

As best shown in FIG. 5, the exit guide vanes 34 are symmetrically and circumferentially disposed about a center point 23 defined within the middle of the hub 14. Each exit guide vane 34 has a tip region 44 that extends outwardly beyond the end of the back plate 36. The exit guide vanes 34 are also slightly curved towards said center axis 19 from said outer region 34B coupled with said outer support ring 42 to said inner region 34A coupled to said back plate 36. This arrangement promotes the movement of air flowing through the axial fan 10 in a more axial direction towards said engine 12 as it passes through the tunnels 32.

As best shown in FIGS. 5 and 6, the back plate 36 also has a plurality of holes 40 that are used to secure the diffuser 28 to the engine 12 via a plurality of screws (not shown) or other attachment devices well known in the art.

Similar to the stator assembly 20, the diffuser 28 is preferably made of a lightweight, high strength material such as molded plastic or fiber reinforced plastic. As above, the diffuser 28 could also be formed of metals such as aluminum.

Figure 8:
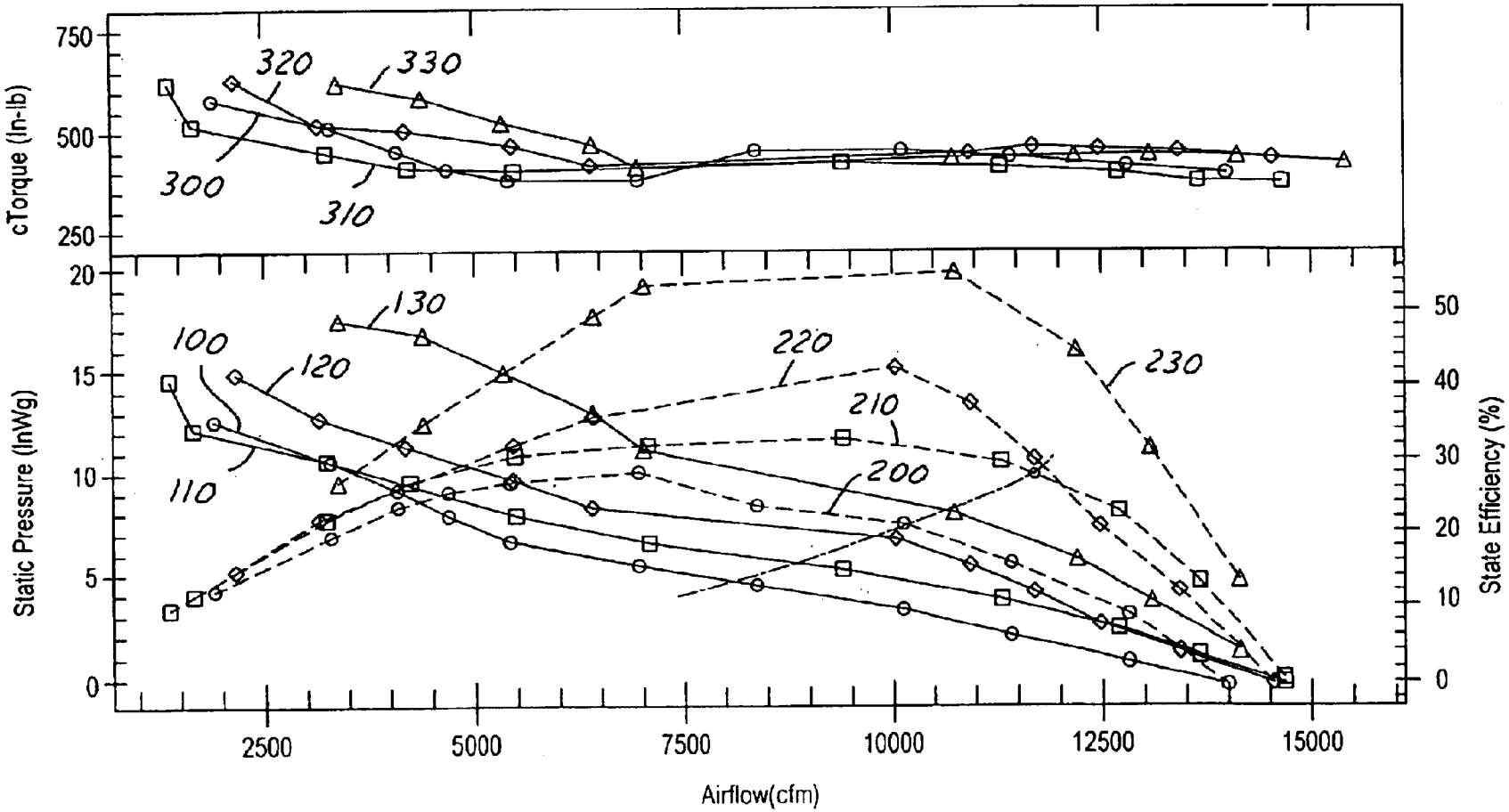
FIG. 8 is a graph illustrating the performance characteristics of the cooling system of FIGS. 1 and 4 versus prior art cooling systems.

FIG. 8 graphically illustrates a comparison of static pressure, static efficiency and torque versus airflow utilizing the various components described in FIGS. 1–3 above. Lines 100, 110, 120 and 130 plot a comparison of static pressure to airflow with cooling systems, while lines 200, 210, 220, and 230 plot static air efficiencies versus airflow. Further, lines 300, 310, 320 and 330 plot torque output versus airflow. As shown in FIG. 4, lines 100, 200 and 300 illustrate the performance of an axial flow fan 10 having a conventional fan shroud structure, while lines 110, 210 and 310 illustrate the addition of a fan shroud having a tighter tip clearance. Lines 120, 220 and 320 illustrate when a stator assembly 20 is added to the fan 10 as shown in FIGS. 1–3, while lines 130, 230 and 330 illustrate the addition of a diffuser assembly 28 to the fan 10 as shown in FIGS. 4–6.

As one of ordinary skill in the art understands, the output velocity of the airflow, expressed in cubic feet per minute (or cfm), from the fan 10 has a rotational component of motion, due to the rotation of the fan blades 16 in direction R, and a linear component $v_x$ induced by the pitch of the fan blades 16. Furthermore, the particular blade form and blade disposition, the variation in pitch along the blade span, or the chord length of the blade (taken along a radial cross section) will affect the static pressure distribution provided immediately adjacent to the fan 10, an hence will affect the flow of air which is passed through the fan 10.

As FIG. 8 illustrates, the addition of tighter tip fan shroud as shown in Line 110 slightly increases the static pressure per unit airflow as compared with cooling systems having a conventional fan shroud, as shown in line 100. Further, such airflow increases at a given static pressure are done without adversely affecting torque requirements, as shown in comparing lines 300 to 310. This leads to increased static efficiency, as shown in comparing lines 200 to 210. These improvements are attributed to the fact that the tighter tip clearance aids in guiding (i.e. deflecting) a portion of the airflow towards the engine at a given static pressure.

Further, the addition of a stator assembly 20 as shown in FIGS. 1–3 increases the static pressure per unit airflow as compared with cooling systems having a either the conventional fan shroud or tighter tip clearance fan shroud, as shown in comparing lines 120 to 110 and 100. Further, such airflow increases at a given static pressure are done without adversely affecting torque requirements, as shown in comparing lines 320 to 310 and 300. This leads to increased static efficiency, as shown in comparing lines 220 to 210 and 200. As described above, these improvements are attributed to the stator blades 26, which function to "break up" the rotational components of air movement and direct more air along an axial flow path towards the engine 12.

Also, the addition of a diffuser 28 as shown in FIGS. 4–7 having the exit guide vanes 34, as shown in line 130, increases the static pressure per unit airflow as compared with cooling systems as shown in lines 120 to 110 and 100. Further, such airflow increases at a given static pressure is done without adversely affecting torque requirements, as shown in comparing line 330 to lines 320 to 310 and 300, especially at airflows of greater than about 7000 cfms. This leads to increased static efficiency, as shown in comparing lines 230 to 220, 210 and 200. As described above, the diffuser 28 decelerates the air flowing through the exit guide vanes 34, the recovered energy thereby increases cooling capabilities of the fan 10 at a given fan 10 rotational speed R.

Thus, the addition of a stator assembly 20 and diffuser 28 acts to increase the flow rate of air in the axial direction through the fan 10 at a given rotational speed. This leads to increased cooling available to the engine at a given engine speed.

Further, as one of ordinary skill in the art appreciates, the static efficiency ($\eta$) is a comparison of the mechanical power into the fan 10, which is torque times speed, and the output of the fan 10, which is flow (Q) times static pressure ($P_s$). From this, the amount of horsepower (HP) required to drive the fan 10 can be calculated using the formula:

$$HP=TR=(QP_s)/\eta$$

where (T) is the torque supplied to drive the fan at a given fan rotational speed. Thus, as the static efficiency increases at a given input rotational speed (i.e. torque), the horsepower required to drive the fan 10 decreases. This leads to increased fuel economy associated with the torque decrease.

Thus the present invention provides a dual approach for increasing the efficiency of the cooling system associated with an engine. First, the addition of a stator assembly 20 or diffuser assembly 28 improves the overall airflow efficiency in the system, thereby leading to increased cooling performance at a given fan rotational speed. Further, the stator assembly 20 or diffuser assembly 28 decreases the torque requirements for rotating the fan at a given engine speed, which leads to improvements in fuel economy. Also, the arrangement of the present invention as described in FIGS. 1–7 reduces noise produced by the rotation of the fan 10, which increases customer satisfaction.

While the invention has been described in connection with one embodiment, it will be understood that the invention is not limited to that embodiment. On the contrary, the invention covers all alternatives, modifications, and equivalents as may be included within the spirit and scope of the appended claims.

What is claimed is:

1. A cooling system for an engine having improved airflow efficiency and performance comprising:

an axial fan mounted to the engine, said axial fan having a plurality of fan blades coupled circumferentially disposed about and coupled to a central hub, each of said plurality of fan blades having a tip portion located in further proximity from said central hub; and a stator assembly coupled between said axial fan and the engine, said stator assembly used to reduce the rotational component of air movement caused by the rotation of said fan around a central axis and to increase the static pressure per unit airflow at a respective rotational speed of the fan, wherein said stator assembly is coupled to a radiator shroud of a closely coupled radiator.

2. The cooling system of claim 1, wherein said stator assembly comprises a plurality of stator blades coupled to a backside of a stator support outer ring and an inner ring.

3. The cooling system of claim 2, wherein said stator support outer ring is circumferentially coupled around said tip portion of each of said plurality of fan blades.

4. The cooling assembly of claim 1, wherein said stator assembly has at least one mounting clip for mounting said stator assembly to the engine.

5. The cooling assembly of claim 1, wherein each of said stator blades is curved concavely with respect to said central axis and said inner ring to direct at least a portion of the movement of air flowing through said axial fan in an axial direction towards the engine.

6. The cooling system of claim 1, wherein said stator assembly comprises a molded plastic stator assembly.

7. A cooling system for an engine having improved airflow efficiency and performance comprising:

an axial fan mounted to the engine, said axial fan having a plurality of fan blades coupled circumferentially disposed about and coupled to a central hub, each of said plurality of fan blades having a tip portion located in further proximity from said central hub; and a diffuser mounted between the engine and said axial fan, said diffuser having plurality of exit guide vanes coupled between a back plate and an outer support ring;

said outer support ring having a front shroud extending outwardly away from the engine, wherein said front shroud is coupled to a radiator shroud of a closely coupled radiator;

said diffuser used to increase the static pressure per unit airflow at a respective rotational speed of the fan.

8. The cooling system of claim 7, wherein said tip portion is closely coupled within said outer support ring.

9. The cooling system of claim 7, wherein said back plate is mounted to the engine.

10. The cooling system of claim 7, wherein each of said plurality of exit guide vanes has an outer region coupled to said outer support ring and an inner region coupled to an inner support ring and is curved slightly inwardly towards said center axis from said outer region to said inner region.

11. The cooling system of claim 7, wherein each adjacent pair of said exit guide vanes, said back plate, and said outer ring define one of a plurality of tunnels within said diffuser through which air may be decelerated.

12. A method for increasing the cooling efficiency of a fan coupled to an engine while decreasing horsepower used to drive the fan, the fan having a plurality of fan blades axially displaced around a central hub section and capable of rotating about a central axis, the method comprising coupling a device between the fan and engine that increases the static pressure per unit airflow between the engine and the fan at a given fan rotational speed, wherein said device is coupled to a radiator shroud of a closely coupled radiator.

13. The method of claim 12, wherein coupling a device comprises coupling a stator assembly between the plurality of fan blades and the engine such that a tip portion of each of the plurality of fan blades is closely coupled with said stator assembly, said stator assembly comprising a plurality of stator blades coupled between a stator support outer ring and an inner ring.

14. The method of claim 12 further comprising mounting said stator assembly to the engine via a plurality of mounting clips formed on said stator assembly.

15. The method of claim 12, wherein coupling a device comprises coupling a diffuser between the fan and the engine, said diffuser comprising a plurality of exit guide vanes coupled between an outer support ring and a back plate, wherein each adjacent pair of said plurality of exit guide vanes, said back plate, and said outer support ring define a tunnel, said tunnel used to decelerate a quantity of air flowing through said tunnel at a given rotational speed.

16. The method of claim 15 further comprising coupling said diffuser to a radiator shroud of a closely coupled radiator such that said fan is coupled between said diffuser and said radiator.

17. The method of claim 16, wherein coupling said diffuser to said radiator shroud comprises coupling an outer shroud of said diffuser to a radiator shroud of a closely coupled radiator such that said fan is coupled between said diffuser and said radiator, wherein said front shroud extends outwardly away from the engine and towards said closely coupled radiator.

18. A cooling system for an engine having improved airflow efficiency and performance comprising:

an axial fan mounted to the engine, said axial fan having a plurality of fan blades coupled circumferentially disposed about and coupled to a central hub, each of said plurality of fan blades having a tip portion located in further proximity from said central hub; and a diffuser mounted between the engine and said axial fan, said diffuser having plurality of exit guide vanes coupled between a back plate and an outer support ring, said back plate being mounted to the engine, said diffuser used to increase the static pressure per unit airflow at a respective rotational speed of the fan.

19. The cooling system of claim 18, wherein said outer support ring has a front shroud extending outwardly away from the engine.

20. The cooling system of claim 19, wherein said front shroud is coupled to a radiator shroud of a closely coupled radiator.

21. The cooling system of claim 18, wherein said tip portion is closely coupled within said outer support ring.

22. The cooling system of claim 18, wherein each of said plurality of exit guide vanes has an outer region coupled to said outer support ring and an inner region coupled to an inner support ring and is curved slightly inwardly towards said center axis from said outer region to said inner region.

23. The cooling system of claim 18, wherein each adjacent pair of said exit guide vanes, said back plate, and said outer ring define one of a plurality of tunnels within said diffuser through which air may be decelerated.

* * * * *